US005724691A

United States Patent [19]

Wiedeck et al.

[11] Patent Number: 5,724,691

[45] Date of Patent: Mar. 10, 1998

[54] DEPLOYABLE BRIDGE ASSEMBLED FROM INDIVIDUAL COMPONENTS

[75] Inventors: Hans-Norbert Wiedeck, Muelheim an der Ruhr; Wolfgang Diefendahl, Straelen, both of Germany

[73] Assignee: Krupp Foerdertechnik GmbH, Duisburg, Germany

[21] Appl. No.: 616,633

[22] Filed: Mar. 15, 1996

[30] Foreign Application Priority Data

Mar. 23, 1995 [DE] Germany ..... 195 10 582.6

[51] Int. Cl.[6] ..... E01D 15/133; E01D 6/00; E01D 15/00

[52] U.S. Cl. ..... 14/2.4; 14/14; 14/4

[58] Field of Search ..... 14/2.4, 2.5, 3, 14/4, 6, 13, 14, 18, 20, 78; 52/643, 650.1, 650.2, 650.3, 690, 692, 693, 694, 695; 403/169, 171, 217

[56] References Cited

U.S. PATENT DOCUMENTS

| | | | |
|---|---|---|---|
| 1,181,013 | 4/1916 | Inglis | 14/4 |
| 4,094,116 | 6/1978 | Gilb | 52/693 |
| 4,742,590 | 5/1988 | Glassman et al. | 14/1 |
| 4,993,094 | 2/1991 | Muller | 14/1 |
| 5,008,967 | 4/1991 | Barrios et al. . | |
| 5,570,486 | 11/1996 | Wiedeck | 14/13 |

FOREIGN PATENT DOCUMENTS

| | | |
|---|---|---|
| 1 193 224 | 5/1965 | Germany . |
| 1 989 041 | 2/1968 | Germany . |
| 42 40 574 | 6/1994 | Germany . |

*Primary Examiner*—Tamara L. Graysay
*Assistant Examiner*—Gary S. Hartman
*Attorney, Agent, or Firm*—Spencer & Frank

[57] ABSTRACT

A deployable bridge is assembled from individual components. The components include cross girders and pavement slabs disposed between the cross girders, the cross girders each having opposite ends and first and second continuous girders each disposed along one of the opposite ends, respectively, of the cross girders. Each continuous girder comprises an upwardly pointing truss having top and bottom chords and truss members arranged between the top and bottom chords and connected to the top and bottom chords at top and bottom nodal points, respectively. The top and bottom chords are each divided in regions of the top and bottom nodal points into a plurality of top chord members and bottom chord members. Each continuous girder further includes connecting elements connecting together the top chord members and connecting together the bottom chord members. The truss members are affixed at a top end to the connecting elements of the top chords and at a bottom end to either the connecting elements of the bottom chords or the ends of the cross girders.

11 Claims, 2 Drawing Sheets

DEPLOYABLE BRIDGE ASSEMBLED FROM INDIVIDUAL COMPONENTS

CROSS-REFERENCE TO RELATED APPLICATIONS

This application claims the right of priority of Application 195 10 582.6 filed in Germany on Mar. 23, 1995, the disclosure of which is incorporated herein by reference.

BACKGROUND OF THE INVENTION

The invention relates to a deployable bridge which can be assembled from individual components, and more particularly, to a deployable bridge having first and second continuous girders on respective sides, each being embodied as an upwardly pointing truss, and cross girders and pavement slabs disposed between the continuous girders, wherein the continuous girders include top chords, bottom chords and truss members arranged between the top and bottom chords.

The best-known bridges of this type are the Bailey-Bridge and the D-Bridge of the Fried. Krupp company. In both types of bridges welded steel sections are used. Such welded steel sections are not particularly sensitive with regard to their fatigue strength, but since the bridges must be particularly light, fatigue fractures do occur, especially at the connections of vertical members and diagonal braces with the bottom chord. Therefore, it would not be possible to construct such a bridge system as a welded aluminum truss construction because the critical points in the welded connections tend to fail quickly in terms of their operational stability.

SUMMARY OF THE INVENTION

It is an object of the invention to configure a bridge of the type mentioned in the introduction so that welding at the critical points is not necessary and that a particularly lightweight construction can be selected for the bridge.

The above and other objects are accomplished according to the invention by the provision of a deployable bridge assembled from individual components, comprising: cross girders and pavement slabs disposed between the cross girders, the cross girders each having opposite ends; and first and second continuous girders each disposed along one of the opposite ends, respectively, of the cross girders, each continuous girder comprising an upwardly pointing truss having top and bottom chords and truss members arranged between the top and bottom chords and connected to the top and bottom chords at top and bottom nodal points, respectively, the top and bottom chords each being divided in regions of the top and bottom nodal points into a plurality of top chord members and bottom chord members, each continuous girder further including connecting elements connecting together the top chord members and connecting together the bottom chord members, the truss members each being affixed without necessarily being welded at a top end to the connecting elements of the top chords and at a bottom end to one of (a) a respective one of the connecting elements of the bottom chords and (b) a respective end of the cross girders.

In a bridge constructed according to the invention, the tension members as well as the compression members are embodied to be entirely smooth and without connections of diagonals or posts. The cross sections of the relevant members can therefore be kept very small.

In a preferred embodiment of the invention, it is provided that the members of the top chords and the members of the bottom chords are connected with one another by connecting elements in the form of plug connections. Such plug connections can be made easily and without any particular investment of time. In a further aspect of the invention, the truss members are formed by two section members that are straddled so that they are at a larger distance from one another at the connecting element of the bottom chord, or at the cross girder, than at the connecting element of the top chord of the truss. Owing to this embodiment of the bridge according to the invention, lateral support girders or braces for the top chords are no longer needed. This results in a reduction of the weight of the bridge and of the volume which has to be loaded on transport vehicles.

According to another feature of the invention, the distances between the two section members at the cross girder or at the connecting element of the bottom chords, and at the connecting element of the top chords, are such that imaginary center lines of the two section members intersect approximately in the center of the cross section of the top chord, with the angle formed by the two section members suitably being approximately 20°. This leads to particularly good lateral stabilization of the top chord.

In a further preferred embodiment of the invention, the members of the top and bottom chords and/or the section members of the truss members are formed of tubes. This offers the advantage of guiding the force flux in the top chords via an internally disposed connecting tube which must not necessarily have any connection to the sleeve-shaped connecting elements.

According to another aspect of the invention, the components of the deployable bridge are made of a light metal, with preferably its billet-shaped components being formed of extruded sections. This allows the manufacture of particularly lightweight bridges.

According to another feature of the bridge according to the invention, the section members are connected with the connecting elements or with the ends of the cross girders by means of pins. This ensures a straight-forward assembly of the bridge.

According to a still further feature of the bridge according to the invention, the ends of the cross girders and/or the connecting elements for the bottom chord are provided with chamber-like configurations or hollow portions, so that the respective component is embodied to be torsionally stiff and ensuring a force transmission from the section members forming the truss members into the cross girders. The hollow portions define a hollow profile with different chamber-like compartments.

The bridge according to the invention is explained in greater detail below in connection with the accompanying drawings.

DETAILED DESCRIPTION OF THE PREFERRED EMBODIMENTS

Figure 1:
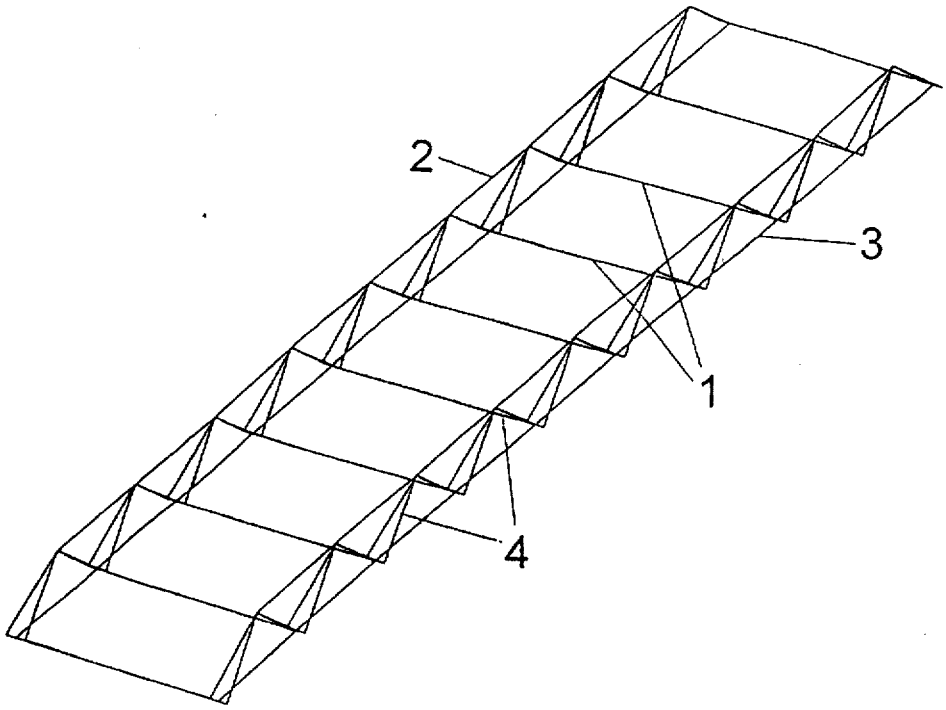
FIG. 1 shows a perspective representation of a bridge according to the invention.
Figure 2:
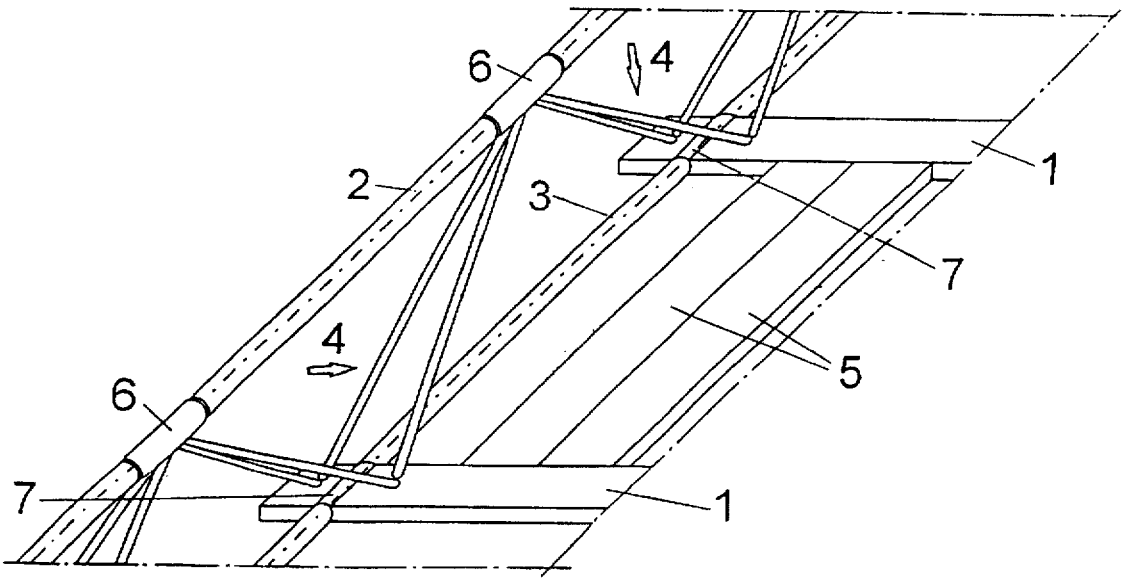
FIG. 2 shows a detail of the supporting structure according to FIG. 1, in perspective and in larger scale.

Referring to FIGS. 1 and 2, there is shown a supporting structure comprised of cross girders 1, top chords 2, bottom chords 3 and truss members 4. In the bridge formed by the supporting structure, the pavement is formed by pavement slabs 5 (FIG. 2). In a region of the upper nodal points, where truss members 4 are connected to the top chords, top chords 2 are divided and the members of top chords 2 are connected with one another by connecting elements 6. The members of bottom chords 3, which are also divided in a region of the bottom nodal points, where truss members 4 are connected to the bottom chord, are connected with one another by way of connecting elements 7. In the illustrated embodiment, truss members 4 are connected with connecting elements 6 and cross girders 1 as shown in FIG. 2.

Figure 3:
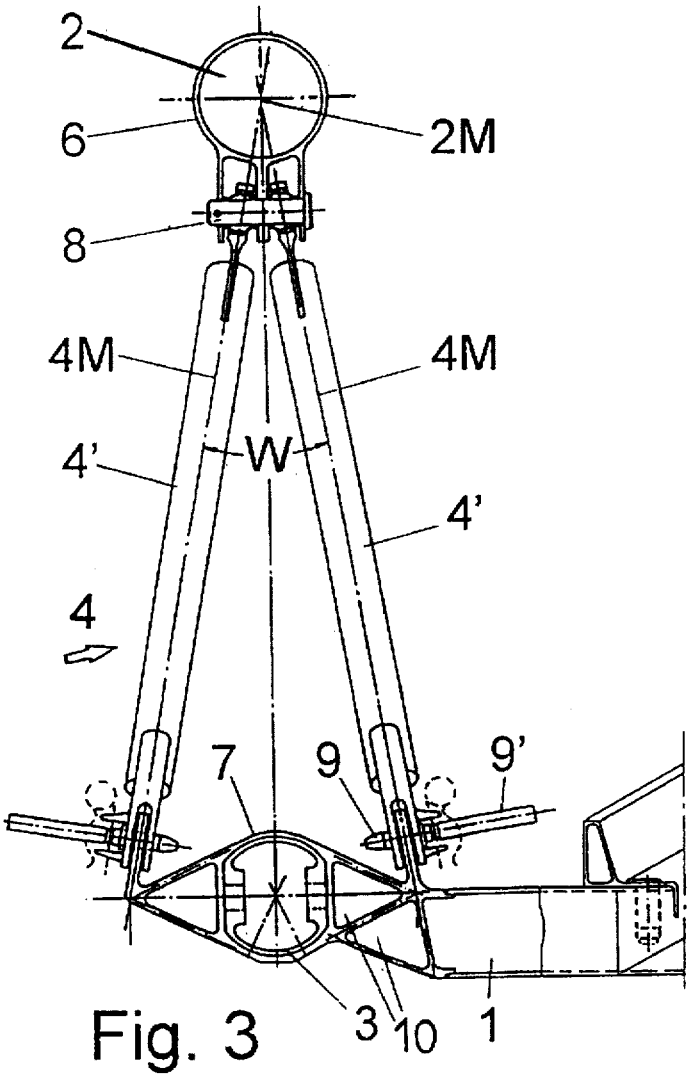
FIG. 3 is a cross section, in a still larger scale, of the end of a cross girder of the supporting structure according to an embodiment slightly modified with respect to FIG. 2, with the connecting element of the bottom chords to which the truss members are affixed as well as the connecting element of the top chords.

In the slightly modified embodiment according to FIG. 3 shows that truss members 4 are embodied as two straddled section members 4' forming an angle W with one another of approximately 20°, with the imaginary center lines 4M of section members 4' intersecting in the center 2M of the cross section of top chord 2 or, more precisely, of connecting element 6. FIG. 3 shows further that connecting elements 7 of bottom chords 3 are arranged at the ends of cross girders 1 and that section members 4' are connected to connecting elements 6 and 7. The connection of section members 4' with the connecting elements 6 is effected by pins 8 and the connection of the section members 4' with the connecting elements 7 by pins 9. As seen in FIG. 3, the end of cross girder 1 and the connecting element 7 comprise chamber-like configurations, or hollow portions 10 disposed adjacent one another. The cross section of hollow portions 10 shown in FIG. 3 clearly depicts hollow regions bounded on at least the sides thereof by walls of the shown cross girder 1 and connecting element 7, that is, a hollow profile with different chamber-like compartments. Pins 9 are provided with handle-type extensions 9' for easier handling.

Figure 4:
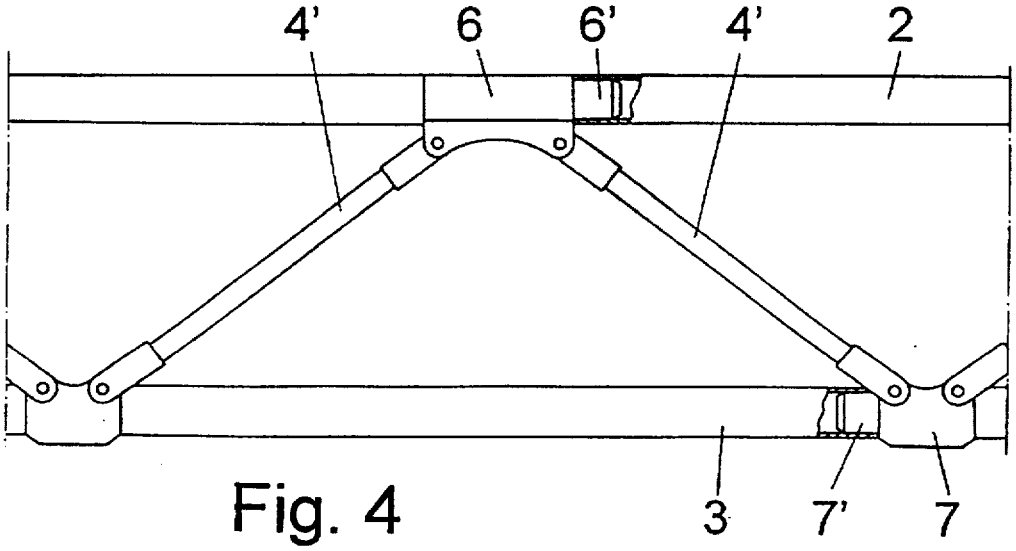
FIG. 4 is a side view of a portion of a bridge section according to the embodiment of FIG. 3.

In the embodiment shown in FIG. 4, top chords 2 and bottom chords 3 as well as the section members 4' are formed of tubes. Connecting elements 6 and 7 are provided with arbor-type projections 6' and 7', respectively, which allow plug connections between connecting elements 6 and members of the top chords 2, and between connecting elements 7 and members of bottom chords 3.

The invention has been described in detail with respect to preferred embodiments, and it will now be apparent from the foregoing to those skilled in the art that changes and modifications may be made without departing from the invention in its broader aspects, and the invention, therefore, as defined in the appended claims is intended to cover all such changes and modifications as fall within the true spirit of the invention.

What is claimed is:

1. A deployable bridge assembled from individual components, comprising:

cross girders and pavement slabs disposed between the cross girders, the cross girders each having opposite ends;

first and second continuous girders each disposed along one of the opposite ends, respectively, of the cross girders, each continuous girder comprising an upwardly pointing truss having top and bottom chords and truss members arranged between the top and bottom chords and connected to the top and bottom chords at top and bottom nodal points, respectively, the top and bottom chords each being divided in regions of the top and bottom nodal points into a plurality of top chord members and bottom chord members, each continuous girder further including connecting elements which connect the top chord members together and the bottom chord members together, the truss members each being affixed at a top end to the connecting elements of the top chords and at a bottom end to one of (a) a respective one of the connecting elements of the bottom chords and (b) a respective end of the cross girders.

2. A bridge according to claim 1, wherein the connecting elements connecting together the top chord members and the bottom chord members comprise plug connections.

3. A bridge according to claim 1, the truss members comprise two section members straddled so that they are at a larger distance from one another at the bottom end than at the top end.

4. A bridge according to claim 3, wherein the top chord has a cross section with a center, and the two section members are disposed at a distance between one another at the bottom end and at the top end so that imaginary center lines of the two section members intersect approximately in the center of the cross section of the top chord.

5. A bridge according to claim 3, wherein the two section members form an angle of approximately 20°.

6. A bridge according to claim 3, wherein the top and bottom chord members comprise tubes.

7. A bridge according to claim 3, wherein the section members comprise tubes.

8. A bridge according to claim 3, wherein components of the bridge are comprised of a light metal.

9. A bridge according to claim 3, wherein components of the bridge are made of extruded sections.

10. A bridge according to claim 3, further comprising pins connecting the section members at the top end to the connecting elements which connect the top chord members together and pins connecting the section members at the bottom end to ends of the cross girders.

11. A bridge according to claim 1, wherein the connecting elements at the bottom ends comprise hollow portions disposed near each end of the respective cross girders.

* * * * *